US011874052B2

(12) United States Patent
Pierce et al.

(10) Patent No.: US 11,874,052 B2
(45) Date of Patent: Jan. 16, 2024

(54) SELECTIVE AIR FLOW SYSTEM FOR A REFRIGERATOR APPLIANCE

(71) Applicant: Haier US Appliance Solutions, Inc., Wilmington, DE (US)

(72) Inventors: Andrew Pierce, Louisville, KY (US); Jonah Connelly, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 27 days.

(21) Appl. No.: 17/412,332

(22) Filed: Aug. 26, 2021

(65) Prior Publication Data

US 2023/0063487 A1 Mar. 2, 2023

(51) Int. Cl.

| | |
|---|---|
| ***F25D 17/04*** | (2006.01) |
| ***F25D 17/06*** | (2006.01) |
| ***F25D 23/02*** | (2006.01) |

(52) U.S. Cl.

CPC ..... *F25D 17/045* (2013.01); *F25D 17/065* (2013.01); *F25D 23/021* (2013.01); *F25D 23/028* (2013.01); *F25D 2317/061* (2013.01); *F25D 2317/067* (2013.01); *F25D 2317/0682* (2013.01)

(58) Field of Classification Search

CPC .... F25D 17/045; F25D 17/065; F25D 23/021; F25D 23/028; F25D 2317/061; F25D 2317/067; F25D 2317/0682

See application file for complete search history.

(56) References Cited

U.S. PATENT DOCUMENTS

| | | | | |
|---|---|---|---|---|
| 3,237,415 | A | 3/1966 | Newton | |
| 4,662,186 | A * | 5/1987 | Park | F25D 17/065 62/265 |
| 5,778,694 | A | 7/1998 | Jeong | |
| 6,058,726 | A * | 5/2000 | Noritake | F25D 17/045 137/870 |
| 8,015,839 | B2 | 9/2011 | An | |
| 8,505,318 | B2 | 8/2013 | Parle | |
| 2018/0299182 | A1 | 10/2018 | Besore | |
| 2018/0347886 | A1 | 12/2018 | Cha | |

FOREIGN PATENT DOCUMENTS

| | | | |
|---|---|---|---|
| CN | 111271923 | A | 6/2020 |
| WO | WO-2019244709 | A1 * | 12/2019 |

OTHER PUBLICATIONS

Translated_Masashi (Year: 2019).*

* cited by examiner

*Primary Examiner* — Elizabeth J Martin
*Assistant Examiner* — Samba Gaye
(74) *Attorney, Agent, or Firm* — Dority & Manning, P.A.

(57) ABSTRACT

A refrigerator appliance includes a cabinet forming a refrigerating compartment defining a plurality of cooling zones, an air circulation duct in fluid communication with the refrigerating compartment, an evaporator provided in the air circulation duct, and a damper assembly in fluid communication with the air circulation duct and the refrigerating compartment. The damper assembly includes a plurality of doors to selectively allow air to enter into selected cooling zones within the refrigerating compartment.

17 Claims, 7 Drawing Sheets

SELECTIVE AIR FLOW SYSTEM FOR A REFRIGERATOR APPLIANCE

FIELD OF THE INVENTION

The present subject matter relates generally to refrigerator appliances, and more particularly to air flow systems for refrigerator appliances.

BACKGROUND OF THE INVENTION

Refrigerator appliances generally include a cabinet that defines a food storage chamber. These refrigerator appliances typically include air circulation systems to circulate cold or cool air throughout the food storage chamber to maintain a desired temperature within the food storage chamber. For instance, a fan may circulate air over an evaporator before supplying the air to the chamber via an air inlet. Recently, certain refrigerator appliances are being used to store a variety of different items, including for example food products, beverages, medication, and other items. Many of these items ideally should be kept at different temperatures. Currently, dedicated storage spaces (e.g., bins) with dedicated air supplies are required in order to maintain specific temperatures. In some examples, separate drawers, chambers, and doors are incorporated to define individual storage spaces.

However, these current methods include complex individual air supplies to each independently defined chamber in order to properly maintain required temperatures. Additionally or alternatively, a construction of the refrigerator appliance itself becomes needlessly complicated, with multiple drawers, doors, and dividers (e.g., mullions) required to keep the individual chambers separate from each other. In some instances, individual air inlets may be positioned to supply air specifically to one area. However, these placements can be unreliable and potentially require modified operation of the refrigeration loop (e.g., altering compressor speeds) to supply different areas of the food storage chamber with different levels of cool air.

Accordingly, a refrigerator appliance having a selective air supply system that obviates one or more of the above-mentioned issues would be useful. An air supply assembly allowing air to be selectively supplied to individual zones would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a refrigerating compartment, the refrigerating compartment comprising a plurality of cooling zones; a cool air chamber provided in the cabinet and configured to supply cool air to the refrigerating compartment; an air circulation duct system in fluid communication with the refrigerating compartment and the cool air chamber, the air circulation duct system comprising a plurality of ducts; and a damper assembly connecting the plurality of ducts with the cool air chamber, the damper assembly selectively allowing air to pass through the plurality of ducts and the refrigerating compartment, the damper assembly comprising a plurality of doors, each door being movable between an open position and a closed position, and wherein the damper assembly selectively allows air from the air circulation duct system to flow through the cabinet through at least one of the plurality of doors.

In another exemplary aspect of the present disclosure, a refrigerator appliance is provided. The refrigerator appliance may include a cabinet defining a refrigerating compartment, the refrigerating compartment comprising a plurality of cooling zones; an air circulation duct in fluid communication with the refrigerating compartment, the air circulation duct comprising an inlet and an outlet; a refrigeration loop comprising a compressor, an evaporator provided in the air circulation duct, a condenser, and a refrigeration line connecting the compressor, the evaporator, and the condenser; and a damper assembly selectively allowing air to pass through the air circulation duct and the refrigerating compartment, the damper assembly comprising a plurality of outlets selectively allowing air to pass through a combination of the plurality of outlets to cool a combination of the plurality of cooling zones.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
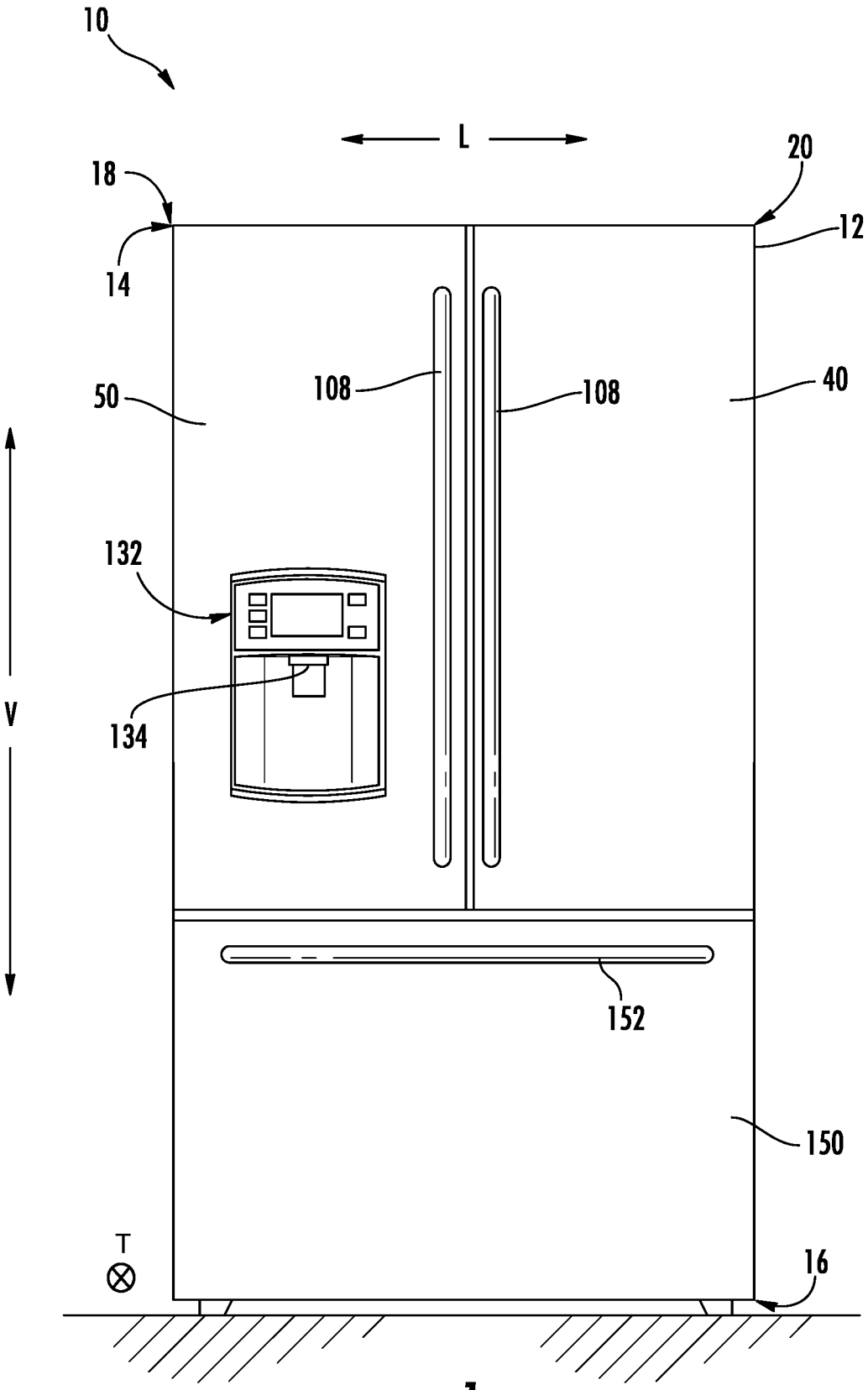
FIG. 1 provides a front elevation view of a refrigerator appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
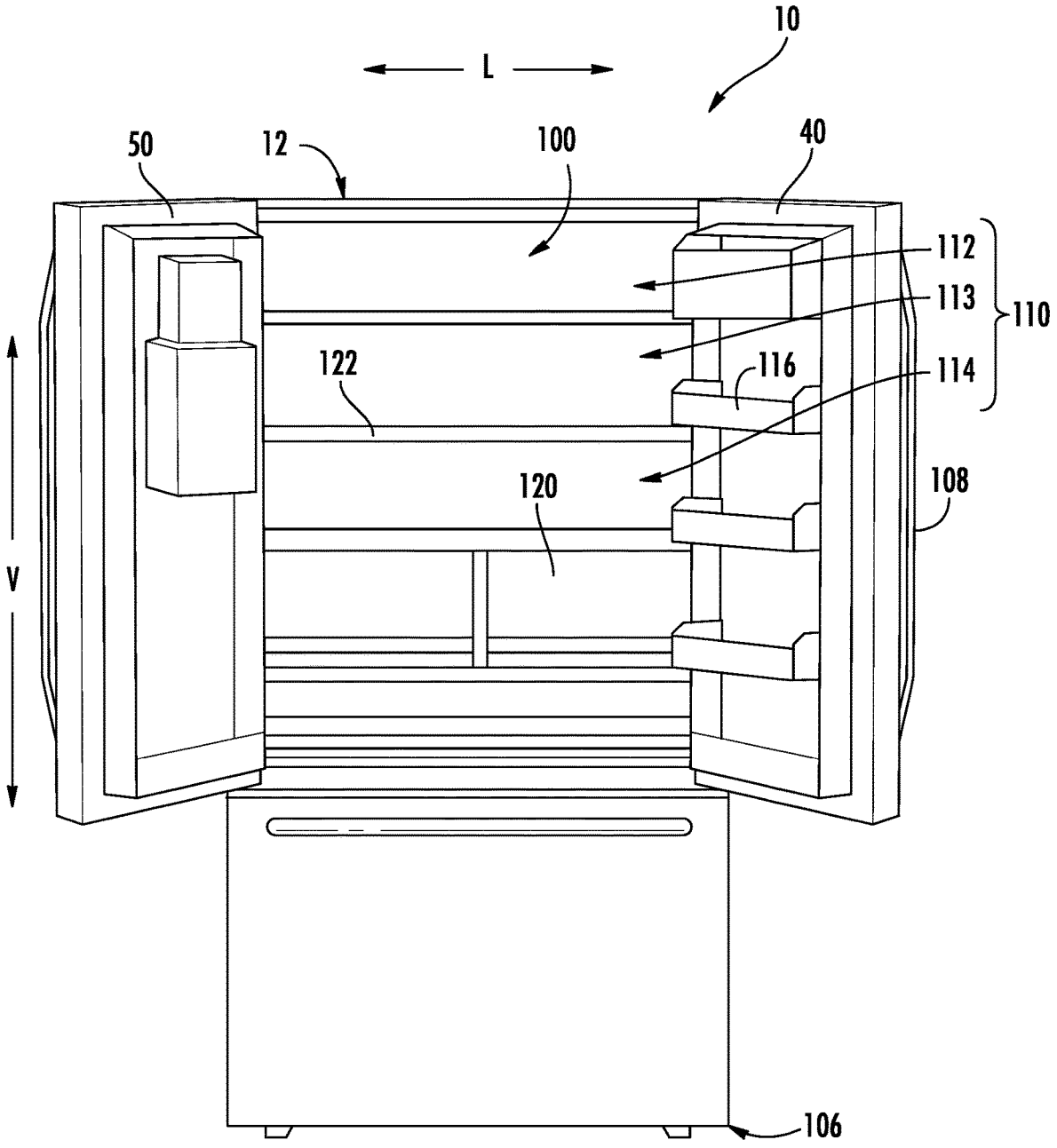
FIG. 2 provides a perspective view of the exemplary refrigerator appliance of FIG. 1, with the doors in an open position.

Referring now to FIGS. 1 and 2, a refrigerator appliance 10 according to an embodiment of the present subject matter defines a vertical direction V, a lateral direction L, and a transverse direction T, each mutually perpendicular to one another. As may be seen, the refrigerator appliance 10 includes a housing or cabinet 12 that extends between a top 14 and a bottom 16 along the vertical direction V, between a left side 18 and a right side 20 along the lateral direction L, and between a front side and a rear side along the transverse direction T.

The cabinet 12 generally defines a refrigerating compartment 100 (FIG. 2) for receipt of items for storage in cool environments. In particular, the refrigerating compartment 100 may be positioned at or adjacent the top 14 of the cabinet 12. It should be appreciated, however, that the refrigerating compartment 100 may be positioned at any suitable location within the refrigerator appliance 10. For example, in one embodiment, the refrigerating compartment 100 may extend from top 14 to bottom 16 along the vertical direction V.

The refrigerator appliance 10 may include one or more refrigerator doors 40, 50 rotatably mounted to the cabinet, e.g., such that the refrigerator doors 40, 50 permit selective access to the refrigerating compartment 100. As shown, in some embodiments, the refrigerator doors 40, 50 include a right refrigerator door 40 and a left refrigerator door 50. The right refrigerator door 40 may be rotatably mounted to the cabinet 12 at the right side 20 of the cabinet 12. The left refrigerator door 50 may be rotatably mounted to the left side 18 of the cabinet 12. A handle 108 may be positioned on each of the refrigerator doors 40, 50 to facilitate movement of the doors 40, 50 between a fully closed position (FIG. 1) and a fully open position (FIG. 2).

The refrigerator appliance 10 may also include a dispenser assembly 132 for dispensing liquid water and/or ice. The dispenser assembly 132 may include a dispenser 134 positioned on or mounted to an exterior portion of the refrigerator appliance 10, e.g., on the left refrigerator door 50. In addition, the refrigerator appliance 10 may include a freezer drawer 150 arranged below the refrigerator doors 40, 50 for selectively accessing items within a frozen food storage chamber (not shown). The freezer drawer 150 may include a handle 152 that is slidably mounted to the cabinet 12. Accordingly, the freezer drawer 150 may be moved in and out of the frozen food storage chamber (not shown) along the transverse direction T.

As shown in FIG. 2, various storage components may be mounted within the food storage chamber 100 to generally facilitate storage of food items. In certain embodiments, the storage components include bins 116, drawers 120, and shelves 122 that are mounted within the fresh food chamber 100. The bins 116, drawers 120, and shelves 122 are configured for receipt of items (e.g., beverages and/or solid food items, medications, etc.) and may assist with organizing such food items. In some embodiments, a plurality of shelves 122 may divide the refrigerating compartment 100 into a plurality of cooling zones 110. For instance, as shown in FIG. 2, refrigerating compartment 100 may define a first cooling zone 112, a second cooling zone 113, and a third cooling zone 114. The cooling zones will be described in more detail below.

Figure 3:
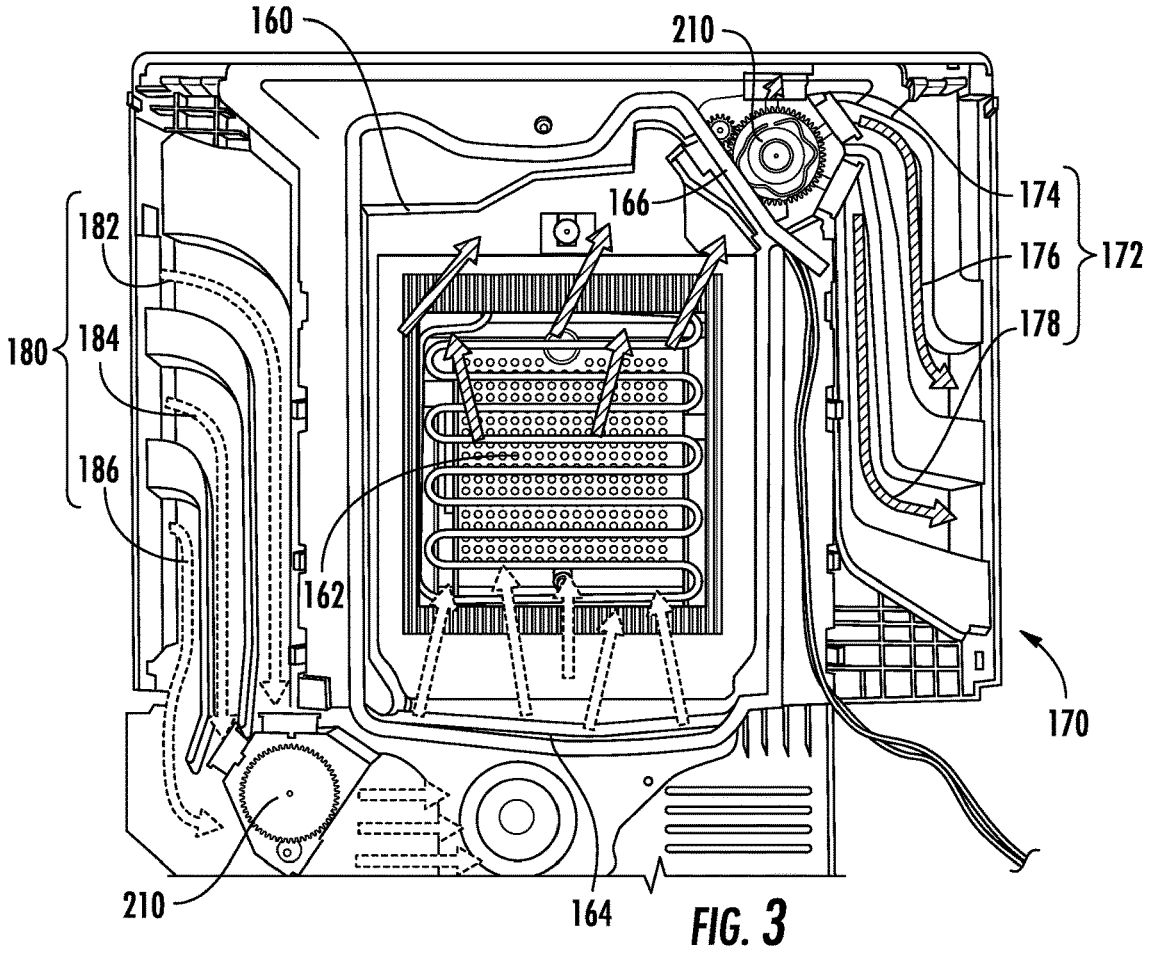
FIG. 3 provides a schematic view of an air supply system of the refrigerator appliance of FIG. 1 according to exemplary embodiments of the present disclosure.
Figure 4:
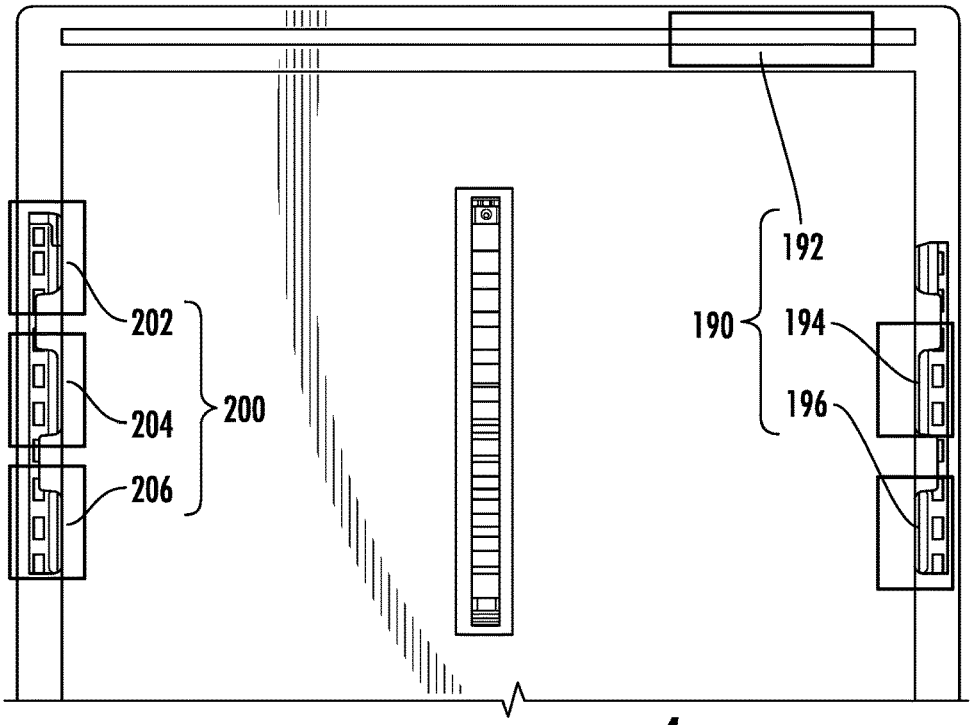
FIG. 4 provides a perspective view of an interior of the refrigerator appliance of FIG. 1, with shelving removed.

FIG. 3 provides a schematic view of an air circulation duct system according to exemplary embodiments of the present disclosure. Particularly, FIG. 3 is shown with a rear interior wall of refrigerating compartment 100 removed, and FIG. 4 is shown with the rear interior wall intact. With reference to FIGS. 3 and 4, the refrigerator appliance may include an evaporator chamber 160. According to some embodiments, evaporator chamber 160 may be provided within cabinet 12, for example behind refrigerating compartment 100 (along the transverse direction T). The evaporator chamber 160 may have an evaporator 162 housed therein. As is well known in the art, evaporator 162 may be part of a refrigeration loop (e.g., including a compressor, a condenser, and an expansion valve) so as to cool a flow of air through evaporator chamber 160. Accordingly, evaporator chamber 160 may define an inlet 164 and an outlet 166. In detail, air circulated through refrigerating compartment 100 may enter evaporator chamber 160 via inlet 164 (e.g., as urged by a fan). Similarly, after passing over evaporator 162, the air may exit evaporator chamber 160 via outlet 166.

Refrigerator appliance 10 may include an air circulation duct system 170. For instance, air circulation duct system 170 may fluidly connect evaporator chamber 160 with refrigerating compartment 100. Air circulation duct system 170 may include a plurality of inlet ducts (or supply ducts) 172 and a plurality of outlet ducts (or return ducts) 180. According to at least some embodiments, the plurality of inlet ducts 172 fluidly connects outlet 166 of evaporator chamber 160 with a plurality of compartment inlets 190 of refrigerating compartment 100. Similarly, according to some embodiments, the plurality of outlet ducts 180 fluidly connect inlet 164 of evaporator chamber 160 with a plurality of compartment outlets 200. Thus, air may be circulated between refrigerating compartment 100 and evaporator chamber 160. It should be noted that in some embodiments, evaporator chamber 160 may be a cool air chamber. In detail, evaporator chamber 160 may not include an evaporator, and may instead be an intermediate chamber containing cool air. In at least one example, air may be circulated through the freezer chamber instead of evaporator chamber 160. Additionally or alternatively, a separate intermediate cool air chamber may be incorporated between evaporator chamber 160 and refrigerating compartment 100.

The plurality of inlet ducts 172 may include a first inlet duct 174, a second inlet duct 176, and a third inlet duct 178. First inlet duct 174 may connect outlet 166 of evaporator chamber 160 with a first compartment inlet 192 of refrigerating compartment 100. Second inlet duct 176 may connect outlet 166 of evaporator chamber 160 with a second compartment inlet 194 of refrigerating compartment 100. Third inlet duct 178 may connect outlet 166 of evaporator chamber 160 with a third compartment inlet 196 of refrigerating compartment 100. Moreover, first compartment inlet 192 may be positioned directly adjacent to first cooling zone 112. Similarly, second compartment inlet 194 may be positioned directly adjacent to second cooling zone 113 and third compartment inlet 196 may be positioned directly adjacent to third cooling zone 114. Thus, air from evaporator chamber 160 may be selectively supplied to at least one of first cooling zone 112, second cooling zone 113, or third cooling zone 114. As will be described in further detail below, a damper assembly may selectively control the air supplied to each of the compartment inlets.

The plurality of outlet ducts may include a first outlet duct 182, a second outlet duct 184, and a third outlet duct 186. First outlet duct 182 may connect inlet 164 of evaporator chamber 160 with a first compartment outlet 202 of refrigerating compartment 100. Second outlet duct 184 may connect inlet 164 of evaporator chamber 160 with a second compartment outlet 204 of refrigerating compartment 100. Third outlet duct 186 may connect inlet 164 of evaporator chamber 160 with a third compartment outlet 206 of refrigerating compartment 100. Moreover, first compartment outlet 202 may be positioned directly adjacent to first cooling zone 112. Similarly, second compartment outlet 204 may be positioned directly adjacent to second cooling zone 113 and third compartment outlet 206 may be positioned directly adjacent to third cooling zone 114. Thus, air from refrigerating compartment 100 may be selectively supplied to evaporator chamber 160 from at least one of first cooling zone 112, second cooling zone 113, or third cooling zone 114. As will be described in further detail below, a damper assembly may selectively control the air supplied from each of the compartment inlets.

Refrigerator appliance 10 may include a damper assembly 210. Damper assembly 210 may selectively allow air to pass from evaporator chamber 160 to refrigerating compartment 100, and vice versa. Accordingly, a plurality of damper assemblies 210 may be provided. For instance, refrigerator appliance 10 may include a supply damper assembly 210 and a return damper assembly 210. Supply damper assembly 210 may be positioned at or near outlet 166 of evaporator chamber 160, while return damper assembly 210 may be positioned at or near inlet 164 of evaporator chamber 160. Each of supply damper assembly 210 and return damper assembly 210 may be identical. Accordingly, a thorough description of damper assembly 210 will be provided once, and it should be understood that the detailed description applies to the supply damper 210 and the return damper 210.

Damper assembly 210 may define an axial direction A, a radial direction R, and a circumferential direction C. Each of the axial direction A, the radial direction R, and the circumferential direction C may be independent from the vertical direction V, the lateral direction L, and the transverse direction T as mentioned above. Accordingly, damper assembly 210 may be oriented in any suitable direction within refrigerator appliance 10. Damper assembly 210 may include a base plate 212. Base plate 212 may define a plurality of openings 214 therethrough. For instance, base plate 212 may include a planar portion extending along the radial direction R and a plurality of wall portions extending from the planar portion along the axial direction A. The plurality of openings 214 may be defined through the plurality of wall portions. In detail, the plurality of openings 214 may be formed circumferentially about base plate 212 and formed through the radial direction R.

The plurality of openings 214 may correspond to the respective inlet 164 and outlet 166 of the evaporator chamber 160, as well as the plurality of inlet ducts 172 and the plurality of outlet ducts 180. For instance, with reference to the supply damper assembly 210, one opening 214 may correspond to outlet 166 of evaporator chamber 160. Thus, air may flow from evaporator chamber 160 into supply damper assembly 210. Additionally or alternatively, a plurality of openings 214 may correspond to the plurality of inlet ducts 172. In detail, a first opening 214 may be connected to the first inlet duct 174, a second opening 214 may be connected to the second inlet duct 176, and a third opening 214 may be connected to the third inlet duct 178.

Damper assembly 210 may include a plurality of doors 250. For instance, the plurality of doors 250 may correspond to the plurality of inlet ducts 172. Each door 250 may be identical, and accordingly, only one door 250 will be described herein for brevity. It should be understood that each door 250 on each supply damper assembly 210 will incorporate the same description.

Figure 5:
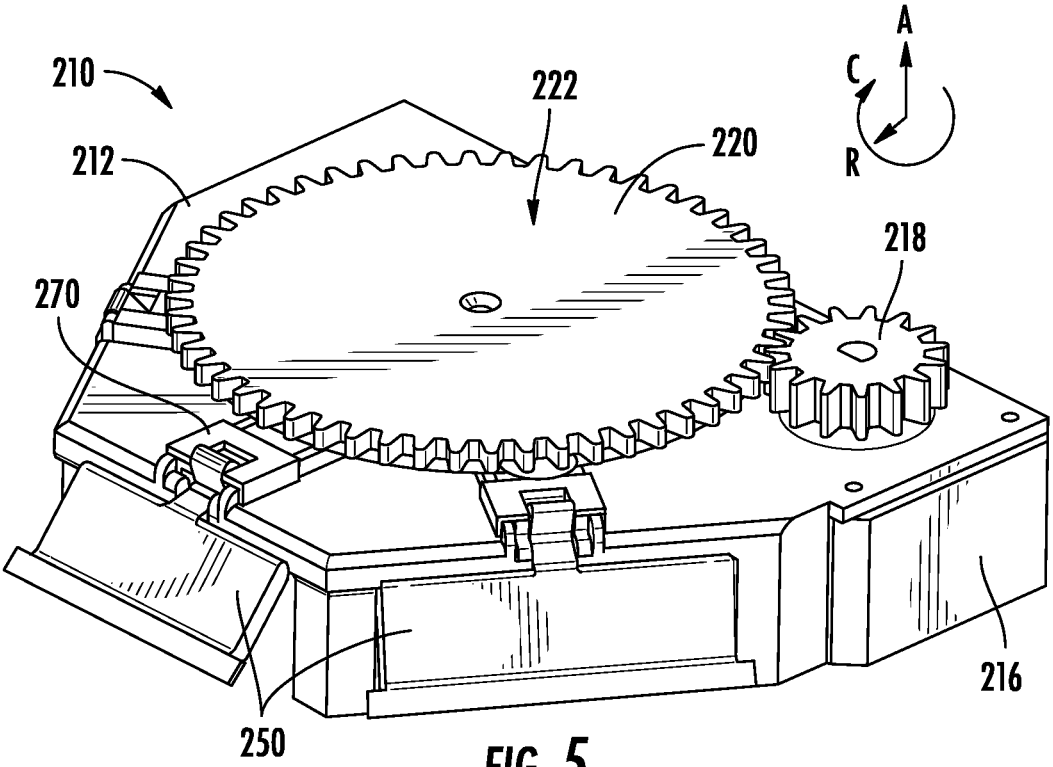
FIG. 5 provides a front perspective view of a damper assembly according to exemplary embodiments of the present disclosure.
Figure 7:
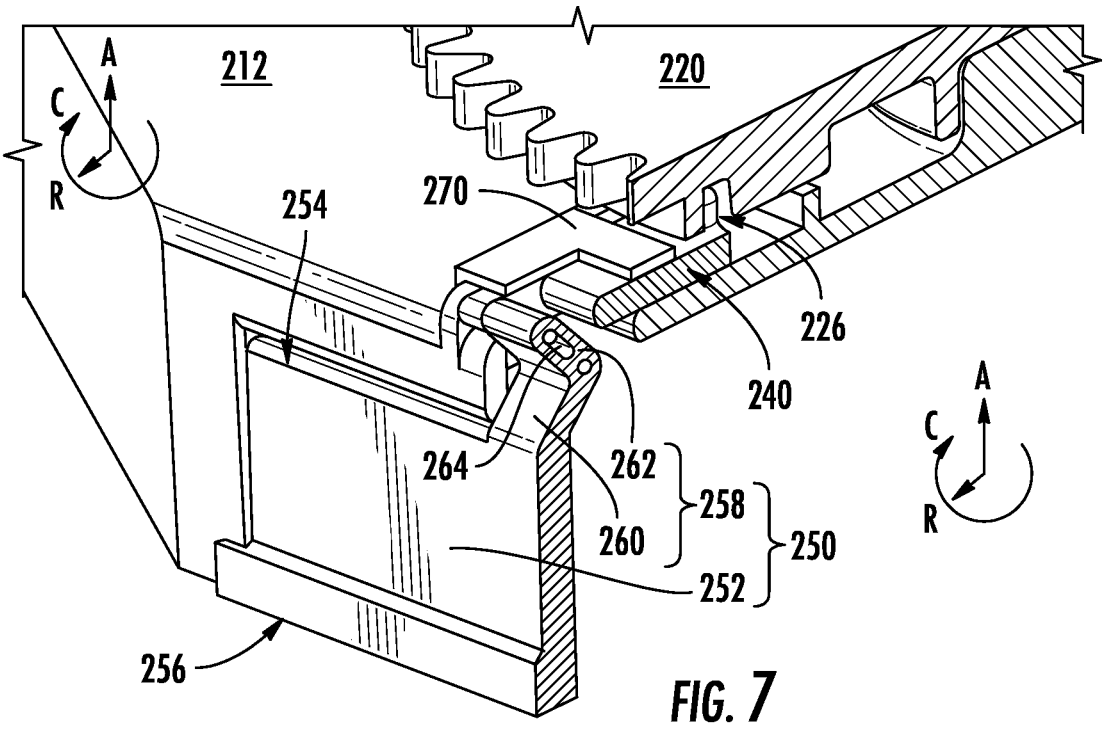
FIG. 7 provides a close-up cut-away view of the exemplary damper assembly of FIG. 5.

Door 250 may include a door body 252. A shape of door body 252 may correspond to a shape of opening 214 of base plate 212. For instance, as shown in FIG. 5, door body 252 may be predominantly rectangular. However, the shape of door body 252 is not limited, and any suitable shape may be incorporated. Door body 252 may define a proximal end 254 and a distal end 256. For example, as shown in FIG. 7, proximal end 254 may be proximate the planar portion of base plate 212, while distal end 256 may be distal the planar portion, opposite proximal end 254. As will be described in further detail below, a pivot point 266 of door 250 may be near proximal end 254.

Figure 8:
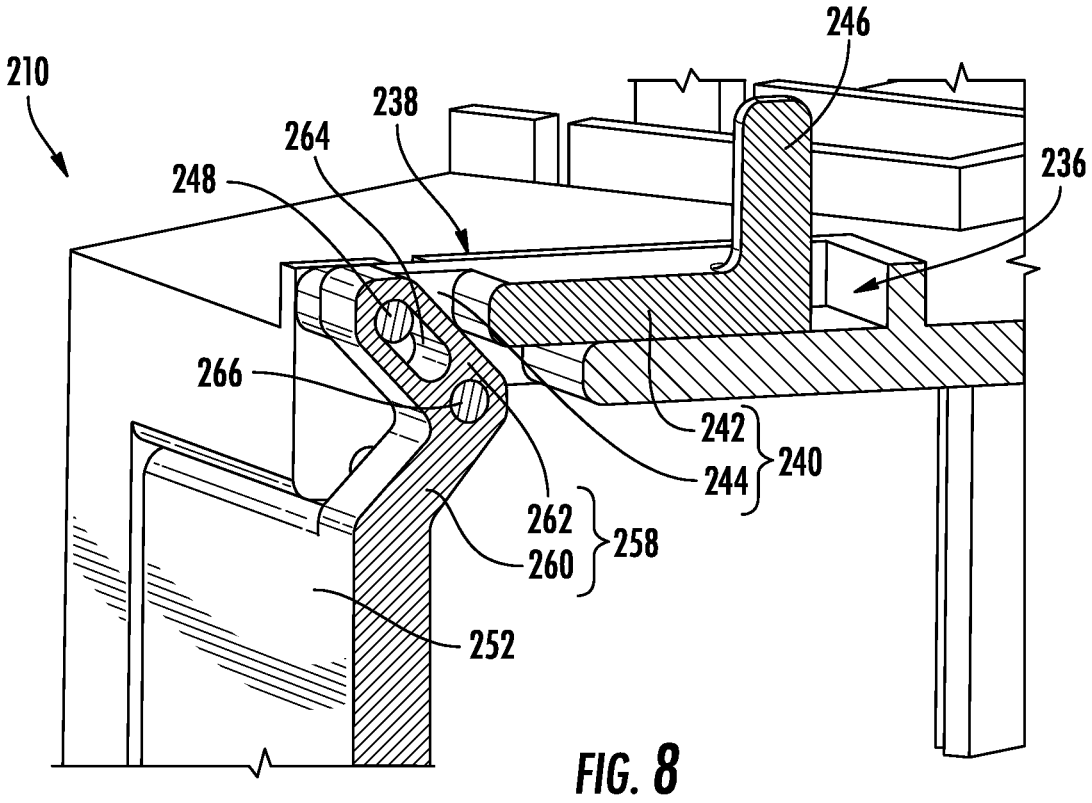
FIG. 8 provides a close-up cut-away view of the exemplary damper assembly of FIG. 5.

Door 250 may include an arm 258 extending from proximal end 254. As best seen in FIG. 8, arm 258 may include a first portion 260 and a second portion 262. First portion 260 may extend at an angle with respect to proximal end 254 of door body 252. For instance, first portion 260 may extend at an angle between the axial direction A and the radial direction R. Additionally or alternatively, first portion 260 may extend inward, e.g., toward a center of base plate 212. Second portion 262 may extend at a right angle from first portion 260. For instance, second portion 262 may extend at an angle between the axial direction A and the radial direction R, perpendicular to first portion 260. Thus, first portion 260 and second portion 262 may collectively form an "L" shape of arm 258. Additionally or alternatively, pivot point 266 of door 250 may be located at or near the junction of first portion 260 and second portion 262.

An elongated slot 264 may be formed through arm 258. For example, elongated slot 264 may be formed through second portion 262 of arm 258. Elongated slot 264 may be formed through arm 258 in a direction perpendicular to the radial direction R. In other words, elongated slot 264 may be formed through arm 258 in a direction tangent to the circumferential direction C. As shown in FIG. 8, elongated slot 264 may form a through-hole that is parallel to an extension direction of door body 252. Additionally or alternatively, elongated slot 264 may extend along an extension direction of second portion 262.

Damper assembly 210 may include a plurality of sliders 240. For instance, the plurality of sliders 240 may correspond to the plurality of doors 250. Each slider 240 may be identical, and accordingly, only one slider 240 will be described herein for brevity. It should be understood that each slider 240 on each supply damper assembly 210 will incorporate the same description.

Slider 240 may include a first translation arm 242 and a second translation arm 244. First translation arm 242 may extend along the radial direction R. For instance, first translation arm 242 may define a first end 236 and a second end 238 opposite the first end 236. First end 236 may be provided radially inward from second end 238. Additionally or alternatively, second end 238 may overlap an edge of base plate 212. Second translation arm 244 may extend from second end 238 of first translation arm 242. In detail, second translation arm 244 may extend along the radial direction R from first translation arm 242 (e.g., parallel to first translation arm 242). Second translation arm 244 may extend further outward (e.g., along the radial direction R) than first translation arm 242. Further, second translation arm 244 may be offset from first translation arm 242, e.g., in a direction perpendicular to the radial direction R (or tangential to the circumferential direction C).

Slider 240 may include a stud 246 extending from first translation arm 242. In detail, stud 246 may extend from first end 236 of first translation arm 242 (e.g., proximate the center of base plate 212) along the axial direction A. For instance, stud 246 may extend in a direction away from base plate 212. Stud 246 may be generally cylindrical in shape (e.g., along the axial direction A). As will be described in more detail below, stud 246 may operably interact with a cam gear (220) to selectively open and close door 250. In detail, slider 240 may be configured to slide along the radial direction R with respect to base plate 212, e.g., between a first position and a second position.

Slider 240 may include a pin 248 extending from second translation arm 244. In detail, pin 248 may extend along the direction perpendicular to the radial direction R (e.g., in the direction tangential to the circumferential direction C). Pin 248 may be provided at a distal end of second translation arm 244. Accordingly, pin 248 may be inserted into elongated slot 264 of arm 258 of door 250. As discussed above, slider 240 may selectively slide along the radial direction R between the first position and the second position. The first position may be referred to as a full extended position. Accordingly, when in the first position, slider 240 may be at a maximum radial distance from the center of base plate 212. Likewise, when in the second position, slider 240 may be at a minimum radial distance from the center of base plate 212. Further, when pin 248 is inserted within elongated slot 264, door 250 may be in a closed position when slider 240 is in the first position. Consequently, as slider 240 moves toward the second position, pin 248 may pull arm 258 (e.g., second portion 262) radially inward via elongated slot 264, thus rotating door 250 (e.g., about pivot point 266) into the open position. Accordingly, door 250 may be perpendicular to base plate 212 (e.g., the planar portion) when in the closed position, and parallel to base plate 212 (e.g., the planar portion) when in the open position.

Damper assembly 210 may include a retainer clip 270. Retainer clip may be fastened to base plate 212 (e.g., the planar portion). Slider 240 may be slidably provided between base plate 212 and retainer clip 270. Thus, retainer clip 270 may restrict a movement of slider 240 along the axial direction A. Retainer clip 270 may be predominantly parallel to base plate 212. Additionally or alternatively, retainer clip 270 may have a "U" shape along the radial direction R, so as to allow arm 258 of door 250 to rotate without interference.

Figure 6:
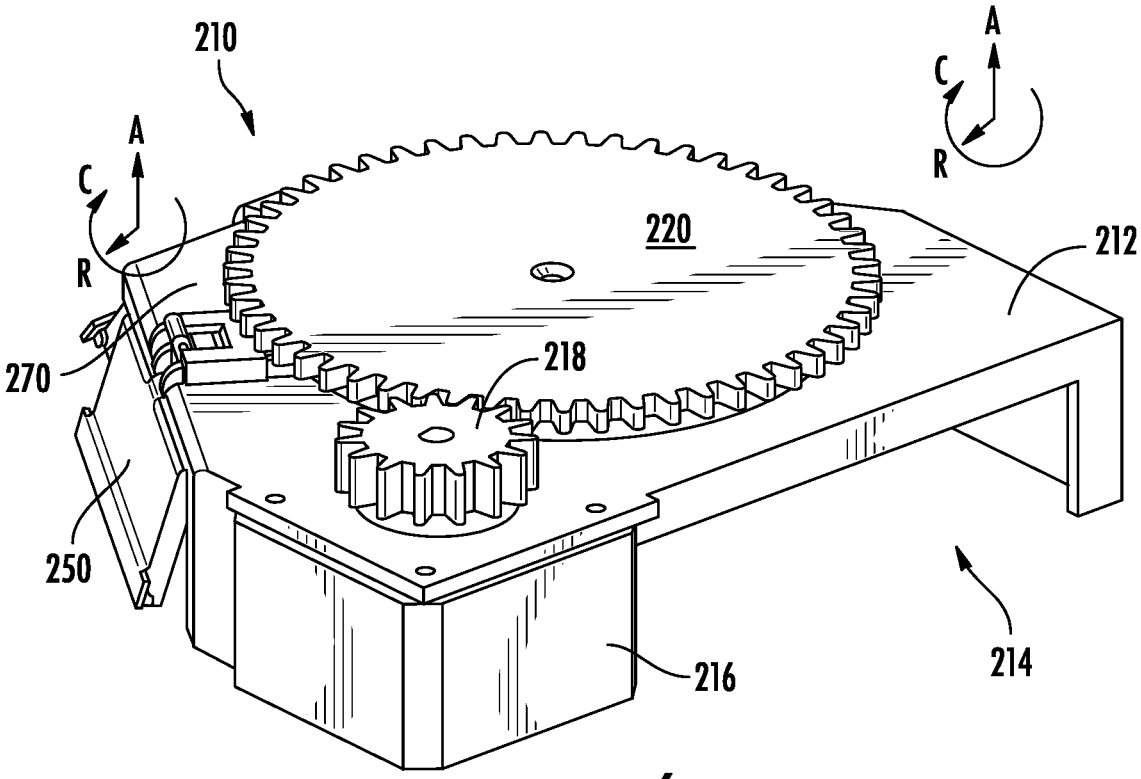
FIG. 6 provides a rear perspective view of the exemplary damper assembly of FIG. 5.

Damper assembly 210 may include a motor 216 attached thereto. Motor 216 may be a stepper motor, however the type of motor is not limited in this disclosure. Motor 216 may be fastened to base plate 212 (e.g., to an underside of base plate 212). For instance, motor 216 may be adjacent to one or more of openings 214. Accordingly, motor 216 may aid in defining one or more of openings 214. Motor 216 may selectively drive a motor gear 218. In some embodiments, motor gear 218 is a standard cylindrical toothed gear (e.g., as shown in FIGS. 5 and 6). However, motor gear 218 may be any suitable type of gear, such as a worm gear, a spiral gear, or the like. Accordingly, motor 216 may drive motor gear 218 in a stepped fashion.

Motor gear 218 may be operably meshed with a cam gear 220. Cam gear 220 may be a similar style to motor gear 218. For instance, if motor gear 218 is a cylindrical toothed gear, cam gear 220 may also be a cylindrical toothed gear. Cam gear 220 may thus be configured to rotate according to a step progression of motor gear 218. Each of motor gear 218 and cam gear 220 may rotate about the axial direction A. Thus, motor gear 218 and cam gear 220 may be parallel with base plate 212 (i.e., parallel with planar portion of base plate 212). Cam gear 220 may define a first axial face 222 and a second axial face 224 opposite the first axial face 222. In some embodiments, first axial face 222 may face away from base plate 212 while second axial face 224 abuts base plate 212.

Figure 9:
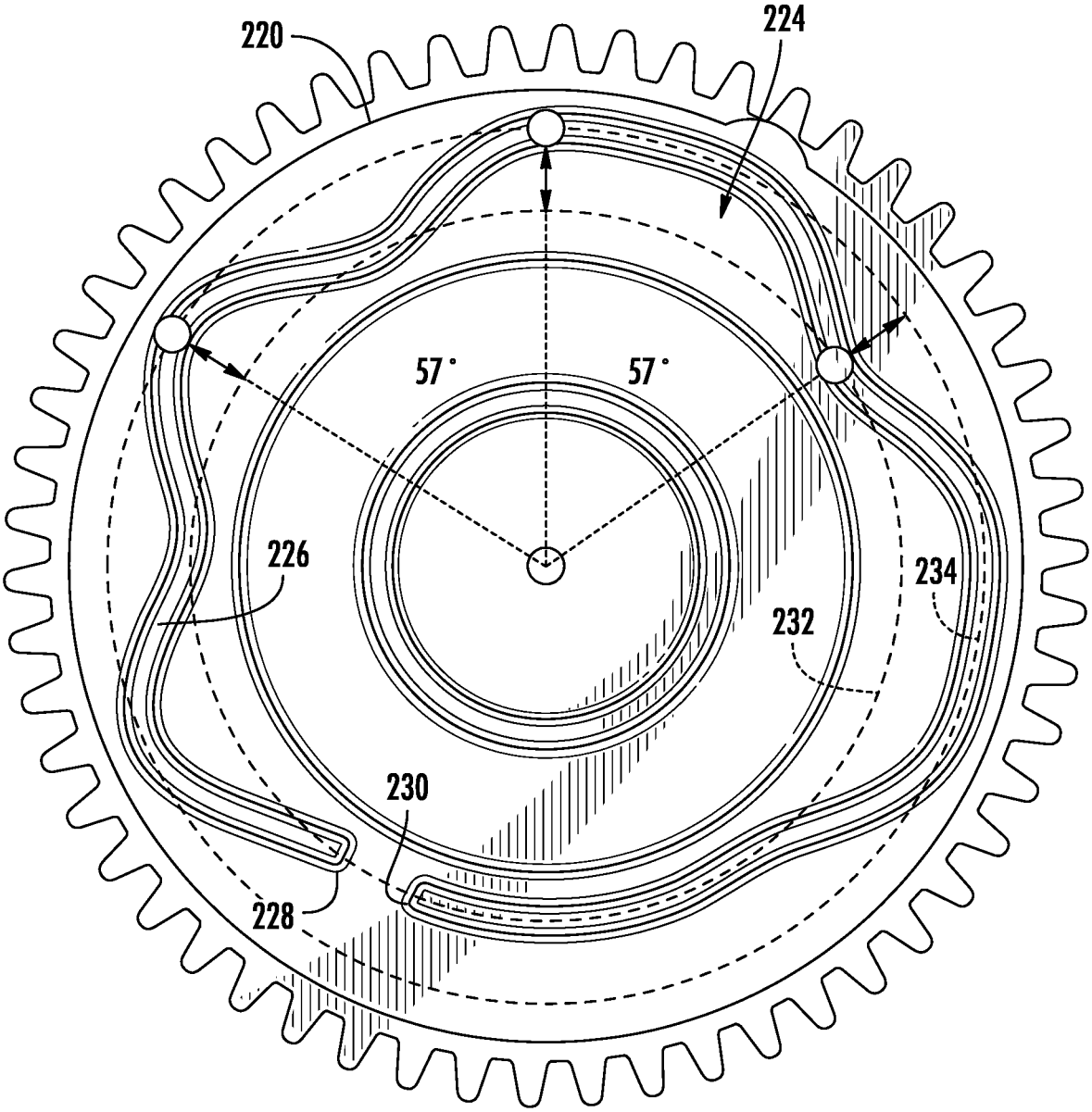
FIG. 9 provides a bottom view of an exemplary cam gear of the damper assembly of FIG. 5.

A cam groove 226 may be formed into, for example, second axial face 224 of cam gear 220. Referring briefly to FIG. 9, cam groove 226 may define a first end 228 and a second end 230. In detail, cam groove 226 may define a serpentine path, roughly circumferential, about second axial face 224 of cam gear 220. In some embodiments, the serpentine path of cam groove 226 may oscillate between an inner diameter (or first diameter) 232 and an outer diameter (or second diameter) 234. Part of cam groove 226 may be defined at inner diameter 232 and part of cam groove 226 may be defined at outer diameter 234. Because cam groove 226 follows the uninterrupted serpentine path from first end 228 to second end 230, some portions of cam groove 226 are defined between inner diameter 232 and outer diameter 234. Thus, cam groove 226 may follow a modified sinusoidal path circumferentially around second axial face 224 of cam gear 220 between inner diameter 232 and outer diameter 234. Additionally or alternatively, cam groove 226 may be recessed into second axial face 224 of cam gear 220.

As shown most clearly in FIG. 7, stud 246 of slider 240 may be inserted into cam groove 226. Because slider 240 is restricted from movement along the circumferential direction C, as cam gear 220 rotates, the serpentine profile of cam groove 226 may act on stud 246 of slider 240, selectively moving slider 240 between the first position and the second position. In detail, when a portion of cam groove 226 at which stud 246 is located is on outer diameter 234 (FIG. 9), slider may be in the first position, and thus door 250 is in the closed position (FIG. 7). As cam gear 220 rotates and a portion of cam groove 226 is on inner diameter 232 (FIG. 9), slider may be in the second position, and thus door 250 is in the open position. Consequently, as discussed above, as cam gear 220 rotates, slider 240 may be moved intermittently between the first position and the second position, and door 250 may be moved intermittently between the open position and the closed position. Thus, an opening and closing of air circulation duct system 170 may be controlled by a position of cam gear 220.

As discussed previously, a plurality of doors 250 may be provided. Consequently, a plurality of sliders 240 may be provided, such that a respective door 250 is operably connected with a respective slider 240. As shown in FIG. 9, sliders 240 may be equally spaced apart from one another, for example along the circumferential direction C. In detail, the sliders 240 may be angularly spaced apart, such that each slider is orientated along the radial direction away from an axial center of cam gear 220. For instance, the angular spacing between each slider 240 may be between about 55° and about 60°. In at least some embodiments, the angular spacing between each slider is about 57°. The angular spacing of the sliders 240 together with the serpentine path of cam groove 226 allows for selective opening and closing of each of the doors 250.

Figure 10:
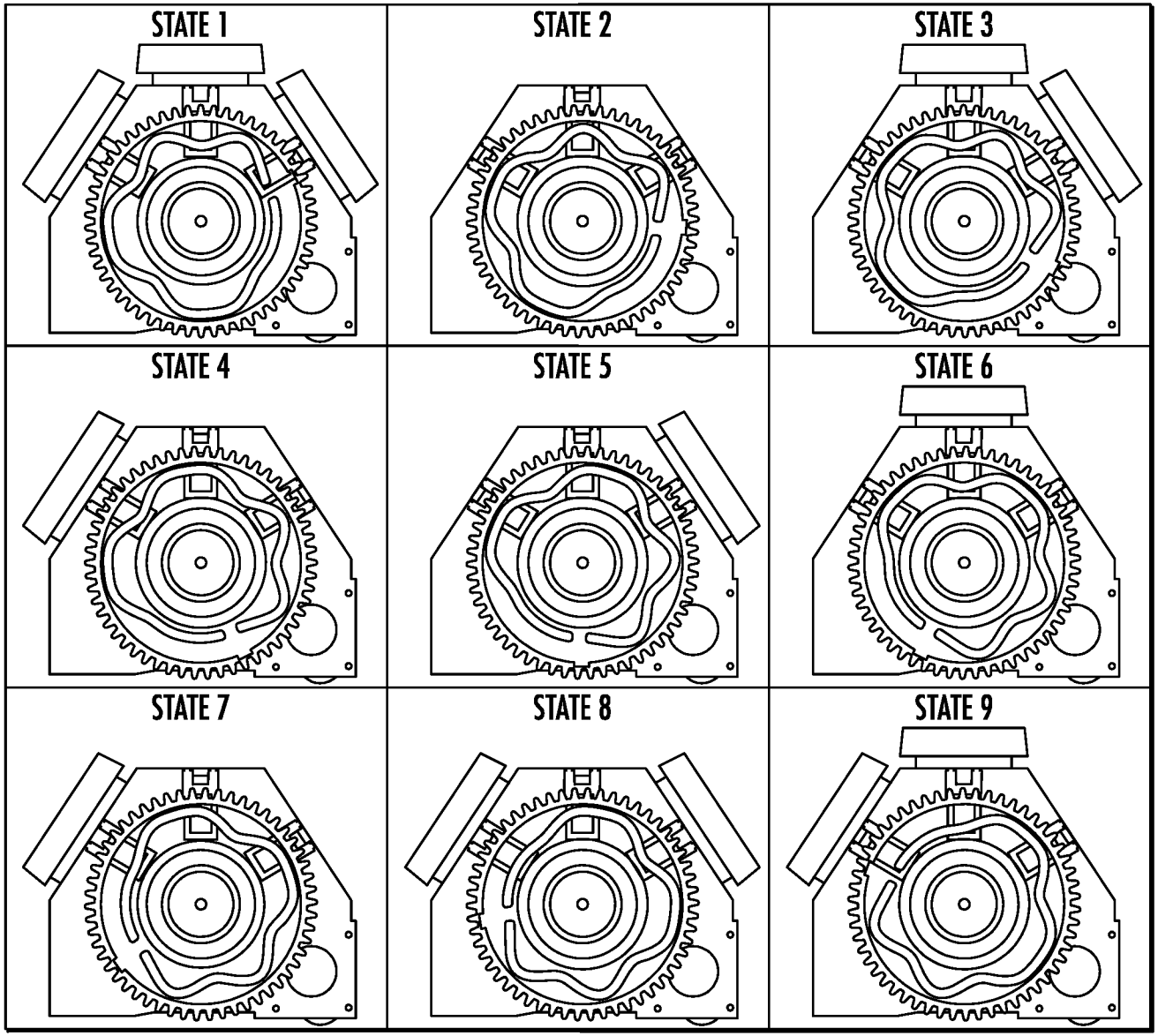
FIG. 10 provides a top view of the exemplary damper assembly of FIG. 5 with doors in various states of opened and closed.

According to at least one embodiment, three doors 250 are provided (and subsequently, three sliders 240 are provided). According to this example, as shown in FIG. 10, motor 216 may selectively rotate cam gear 220 between nine different stages, allowing for any combination of doors 250 to be opened and/or closed. For example, in one state, all three doors 250 are opened, while in another state, two doors are opened, and one is closed. As any combination is possible, refrigerator appliance 10 may selectively supply air to any combination of cooling zones 110 at any time according to a position of cam gear 220.

Additionally or alternatively, as discussed above, damper assembly 210 may include a supply damper assembly 210 and a return damper assembly 210. Each of supply damper assembly 210 and return damper assembly 210 may operate independently. In detail, a state of supply damper assembly 210 may be the same as a state of return damper assembly 210. Thus, air may be supplied to select cooling zones 110 to flow directly through the selected cooling zone 110. Additionally or alternatively, a state of supply damper assembly 210 may be different from a state of return damper assembly 210. Accordingly, a cross-flow of air may be created such that air is supplied through one compartment inlet (e.g., first compartment inlet 192) and returned through a non-corresponding compartment outlet (e.g., third compartment outlet 206). Thus, any feasible and suitable combination of states between the supply damper assembly and the return damper assembly may be utilized. According to some embodiments, the return damper assembly is identical to the supply damper assembly. Additionally or alternatively, a design of the return damper assembly may differ from a design of the supply damper assembly. For instance, according to specific geometric and/or space requirements in various embodiments, a particular fit and finish of the return damper assembly may be altered slightly from that of the supply damper assembly. It should be understood that the general operation of the return damper assembly will be similar to or the same as that of the supply damper assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a refrigerating compartment, the refrigerating compartment comprising a plurality of cooling zones;

a cool air chamber provided in the cabinet and configured to supply cool air to the refrigerating compartment;

an air circulation duct system in fluid communication with the refrigerating compartment and the cool air chamber, the air circulation duct system comprising a plurality of ducts; and a damper assembly connecting the plurality of ducts with the cool air chamber, the damper assembly selectively allowing air to pass through the plurality of ducts and the refrigerating compartment, the damper assembly comprising a plurality of sliders each comprising a pin and a plurality of doors, each door being movable between an open position and a closed position via a respective slider of the plurality of sliders, and wherein the damper assembly selectively allows air from the air circulation duct system to flow through the cabinet through at least one of the plurality of doors, wherein each door of the plurality of doors comprises:

a door body comprising a proximal end and a distal end; and an arm extending from the proximal end of the door body, the arm being integrally formed with the door body, the arm comprising:

a first portion extending from the proximal end of the door body at an acute angle with respect to an axial direction, the first portion defining a first proximal end and a first distal end;

a second portion extending at a right angle from the first distal end of the first portion and defining a second proximal end and a second distal end, and an elongated slot formed through the second portion, the pin being received within the elongated slot, wherein each door of the plurality of doors defines a pivot point provided at a junction between the first portion and the second portion of the arm at the distal end of the first portion.

2. The refrigerator appliance of claim 1, wherein the damper assembly defines the axial direction, a radial direction, and a circumferential direction, and wherein the damper assembly further comprises:

a base plate defining a plurality of openings in the radial direction;

a motor attached to the base plate and extending along the axial direction, the motor being configured to drive a motor gear; and a cam gear operably meshed with the motor gear, the cam gear comprising a cam groove formed into an axial face of the cam gear;

wherein each of the plurality of sliders is slidably attached to the base plate and operably connected with the cam groove, the plurality of sliders each selectively sliding with respect to the base plate between a first position and a second position according to a rotation of the cam gear.

3. The refrigerator appliance of claim 2, wherein each slider of the plurality of sliders comprises:

a first translation arm defining a first end and a second end opposite the first end, the first translation arm extending along the radial direction;

a second translation arm extending from the second end of the first translation arm along the radial direction away from the cam gear; and a stud extending from the first end of the first translation arm along the axial direction, the stud being inserted into the cam groove.

4. The refrigerator appliance of claim 3, wherein the second translation arm comprises:

the pin extending from a distal end of the second translation arm, the pin extending tangentially to the circumferential direction.

5. The refrigerator appliance of claim 4, wherein the pin is inserted into the elongated slot so as to selectively rotate the door between the open position and the closed position according to a position of the slider, and wherein the door is perpendicular to the base plate when in the closed position, and parallel to the base plate when in the open position.

6. The refrigerator appliance of claim 2, further comprising:

a retainer clip fastened to the base plate, wherein the slider is slidably provided between the base plate and the retainer clip.

7. The refrigerator appliance of claim 2, wherein the plurality of doors comprises a first door, a second door, and a third door, and the plurality of sliders comprises a first slider corresponding to the first door, a second slider corresponding to the second door, and a third slider corresponding to the third door.

8. The refrigerator appliance of claim 7, wherein the first door regulates a flow of air from a first duct of the plurality of ducts into a first cooling zone of the plurality of cooling zones, the second door regulates a flow of air from a second duct of the plurality of ducts into a second cooling zone of the plurality of cooling zones, and the third door regulates a flow of air from a third duct of the plurality of ducts into a third cooling zone of the plurality of cooling zones.

9. The refrigerator appliance of claim 7, wherein each of the plurality of sliders is angularly spaced apart along the circumferential direction of the cam gear, the plurality of sliders being separated by between about 55 degrees and about 60 degrees.

10. The refrigerator appliance of claim 9, wherein the plurality of sliders are separated by about 57 degrees.

11. The refrigerator appliance of claim 2, wherein the cam groove defines a first end and a second end, the cam groove following a serpentine circumferential path from the first end to the second end.

12. The refrigerator appliance of claim 11, wherein the serpentine circumferential path is defined between an inner diameter and an outer diameter.

13. The refrigerator appliance of claim 12, wherein when the serpentine circumferential path is at the outer diameter, a respective slider is in the first position and when the serpentine circumferential path is at the inner diameter, a respective slider is in the second position.

14. The refrigerator appliance of claim 2, wherein the plurality of ducts comprises a plurality of inlet ducts connecting an outlet of the cool air chamber to a plurality of inlets to the refrigerating compartment and a plurality of outlet ducts connecting an inlet of the cool air chamber to a plurality of outlets of the refrigerating compartment.

15. The refrigerator appliance of claim 14, wherein the cool air chamber is an evaporator chamber, wherein the damper assembly is a supply damper assembly provided at the outlet of the cool air chamber, and wherein the refrigerator appliance further comprises:

a return damper assembly, the return damper assembly being the same as the supply damper assembly and provided at the inlet of the cool air chamber.

16. A refrigerator appliance, comprising:

a cabinet defining a refrigerating compartment, the refrigerating compartment comprising a plurality of cooling zones;

an air circulation duct in fluid communication with the refrigerating compartment, the air circulation duct comprising an inlet and an outlet;

a refrigeration loop comprising an evaporator provided in the air circulation duct; and a damper assembly selectively allowing air to pass through the air circulation duct and the refrigerating compartment, the damper assembly defining an axial direction, a radial direction, and a circumferential direction, the damper assembly comprising a plurality of outlets selectively allowing air to pass through a combination of the plurality of outlets to cool a combination of the plurality of cooling zones, wherein damper assembly further comprises:

a plurality of doors, each of the plurality of doors selectively covering one of the plurality of outlets, wherein each of the plurality of doors comprises:

a door body; and an arm defining a first portion and a second portion, the arm being integrally formed with the door body as a single piece, wherein the first portion extends from the door inward along the radial direction and upward along the axial direction, and the second portion extends outward along the radial direction and upward along the axial direction from the first portion.

17. The refrigerator appliance of claim 16, wherein the damper assembly is a supply damper assembly provided at the outlet of the air circulation duct, and wherein the refrigerator appliance further comprises:

a return damper assembly, the return damper assembly being identical to the supply damper assembly and provided at the inlet of the air circulation duct.

* * * * *